United States Patent [19]

Elias

[11] 3,946,992

[45] Mar. 30, 1976

[54] CONSTRUCTION FENCE POST

[75] Inventor: Murray A. Elias, Islington, Canada

[73] Assignee: Dell Holdings Limited, Toronto, Canada

[22] Filed: Feb. 28, 1975

[21] Appl. No.: 554,067

[52] U.S. Cl. ..... 256/68; 248/226 R; 256/65

[51] Int. Cl.[2] ..... E04H 17/14

[58] Field of Search ..... 24/248, 263 SB; 256/59, 256/65, DIG. 6, 68; 248/226 B, 226 C

[56] References Cited

UNITED STATES PATENTS

| | | | |
|---|---|---|---|
| 1,280,955 | 10/1918 | Bowen | 248/226 B |
| 2,195,366 | 3/1940 | Haigh | 248/226 B |
| 2,411,421 | 11/1946 | Golden | 248/226 B |
| 3,315,932 | 4/1967 | Chandler | 248/226 B |
| 3,632,089 | 1/1972 | Smith | 256/1 |
| 3,637,182 | 1/1972 | Bohlman | 248/226 B |

*Primary Examiner*—Paul R. Gilliam
*Assistant Examiner*—Doris L. Troutman
*Attorney, Agent, or Firm*—Fetherstonhaugh & Co.

[57] ABSTRACT

A construction fence post including a hollow tubular post having a C-shaped mounting bracket at the lower end thereof, a shank extending through the hollow tubular post and projecting outwardly thereof towards an oppositely disposed arm of the C-shaped clamp and drive means at the upper end of the post for driving the shank towards and away from said arm of the C-shaped clamp to releasably clamp a structure disposed therebetween. The shank is resiliently longitudinally compressible whereby the clamping force is maintained between the shank and the arm when the proportions of the structure which is disposed therebetween vary due to temperature variations or the like.

9 Claims, 4 Drawing Figures

CONSTRUCTION FENCE POST

FIELD OF INVENTION

Figure 1:
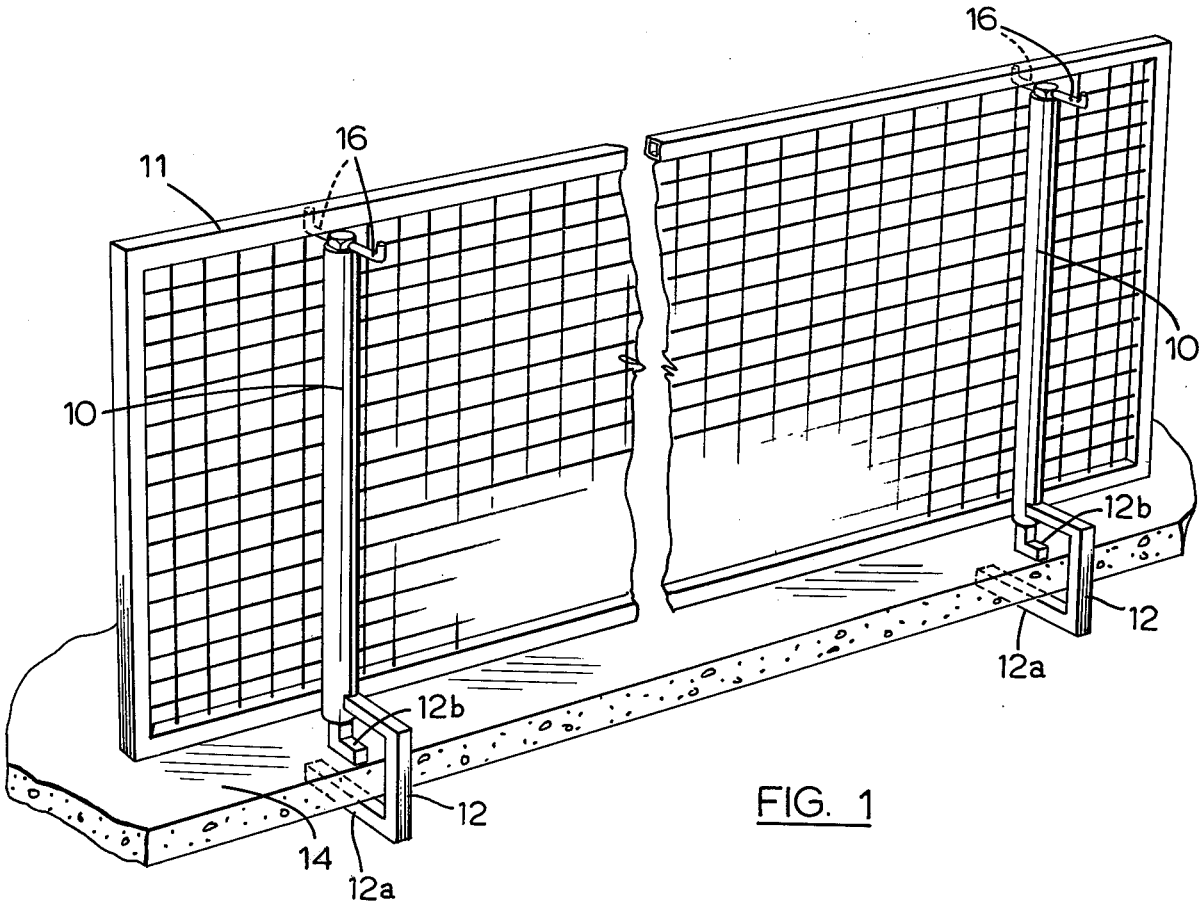

This invention relates to end mounted construction fence post.

PRIOR ART

End mounted fence posts are used in the construction industry to support safety fences and are generally mounted on the edge of a floor of a building under construction. In the known devices a clamping mechanism is located at the lower end of the post which extends over the edge of the floor on which the post is to be mounted. A threaded drive mechanism is provided to effect the required clamping action. One of the difficulties of the known end mounted construction fence posts is that the threaded clamping mechanism is located such that it is necessary for the operator to lean over the edge of the floor in order to tighten or release the clamping mechanism. This is extremely dangerous in the construction of high rise buildings as the operator may easily lose his balance when attempting to make adjustments.

A further difficulty which has been experienced with the known end mounted construction fence construction posts is that the clamping mechanism makes no provision for variations in the thicknesses of the structure on which the post is mounted resulting from temperature variations and the like with the result that a minor contraction of the structure may release the clamping force and the minor expansion may make the release of the clamping mechanism extremely difficult. In addition, much of the operating mechanism of the clamping portion of the known fence posts is exposed and may be damaged in use or in storage to an extent which may make the operation of the clamping mechanism difficult or impossible.

SUMMARY

A further difficulty which has been experienced with the known end mounted construction fence posts is that the clamping mechanism may be released when the post is being used to support the safety fence. As a result it is possible for the known type of post to give the impression of being secure when in fact the post may be very insecurely mounted with respect to the structure on which it is mounted.

The present invention overcomes the difficulties of the prior art described above and provides a simple and efficient end mounted construction fence post in which the clamping operating mechanism is enclosed within the fence post and operable from the upper end of the fence post. The clamping mechanism also incorporates a resiliently compressible shank which maintains an adequate clamping load despite variations in the thickness of the structure on which the clamp is mounted resulting from temperature variations and the like.

According to an embodiment of the present invention there is provided an end mounted construction fence post which comprises a hollow tubular post having a C-shaped bracket mounted at the lower end of the post and opening laterally of the longitudinal axis of the post, a shank extending into the tubular post and having a lower end projecting outwardly from the lower end of the tubular post towards an underlying arm of the C-shaped bracket and drive means operable from the upper end of the post for driving the shank towards and away from the C-shaped bracket whereby the shank may cooperate with the underlying arm of the C-shaped bracket to releasably clamp the post to a structure disposed therebetween, the shank is resiliently longitudinally compressible whereby a clamping force is maintained between the shank and the arm of the C-shaped bracket when the proportions of the structure vary due to temperature variations or the like.

PREFERRED EMBODIMENT

Figure 3:
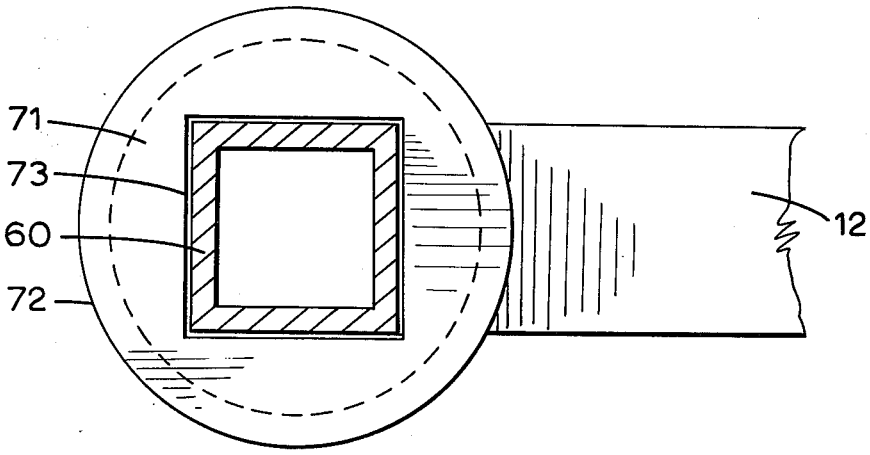
Figure 4:
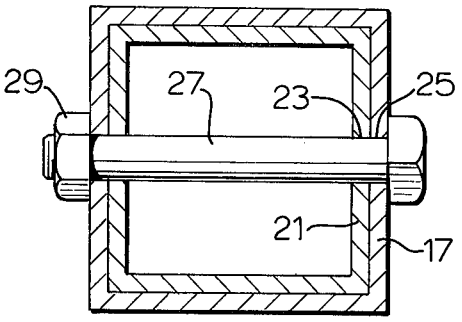
Figure 2:
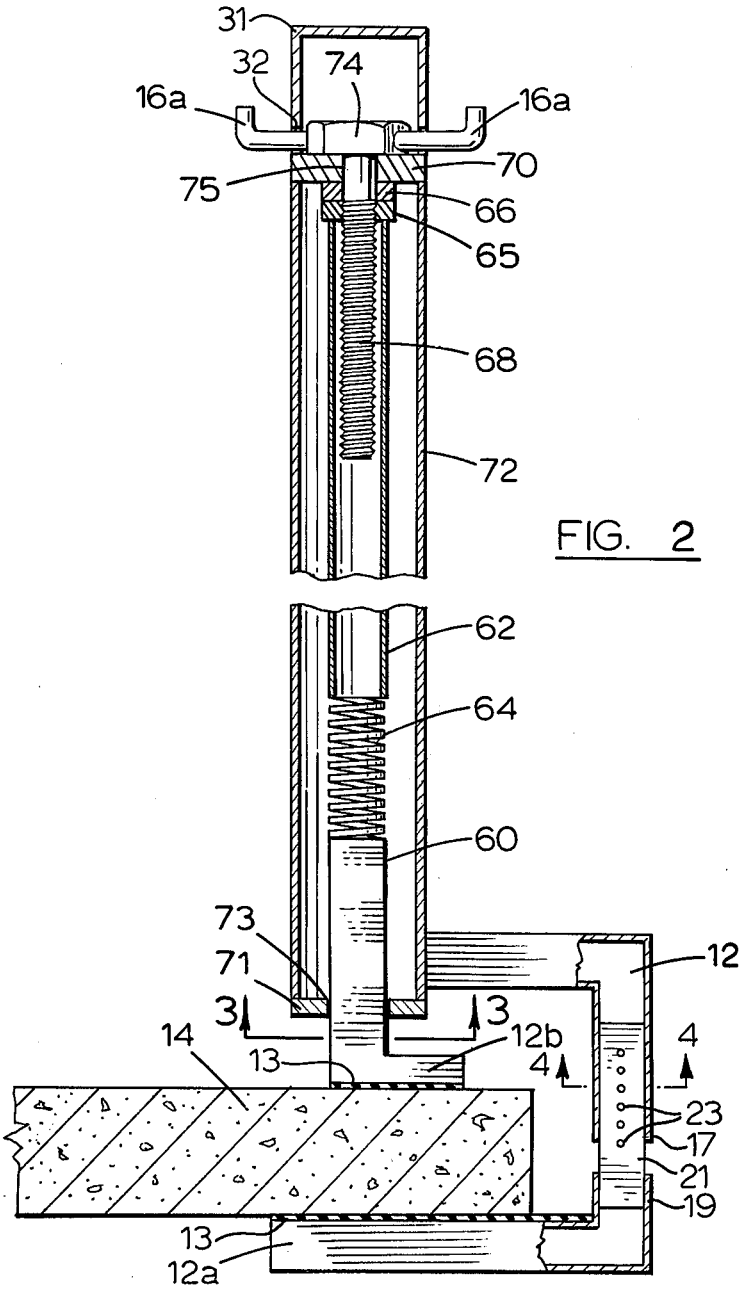

The invention will be more clearly understood after reference to the following detailed specification read in conjunction with the drawings:

FIG. 1 is a pictorial view illustrating the manner in which a construction fence post according to the present invention is employed, FIG. 2 is a partially sectioned side view of an end mounted construction fence post according to an embodiment of the present invention, FIG. 3 is a sectional view taken along the line 3—3 of FIG. 2, and FIG. 4 is a sectional view taken along the line 4—4 of FIG. 2.

With reference to FIG. 1 of the drawings, the reference numeral 10 refers generally to an end mounted construction fence post according to an embodiment of the present invention. The fence posts 10 are mounted on the edge of a floor structure 12 and a safety construction fence 14 is suspended from hooks 16 which are integral parts of the drive mechanism of the clamping mechanism. It will be noted that when the safety fence is mounted on the members 16, the drive mechanism cannot be operated.

With reference to FIG. 2 of the drawings, it will be seen that an adjustable C-shaped clamp member 12 is mounted at the lower end of the tubular post member 72. The C-shaped bracket 12 is preferably welded to the lower end of the post 72 and has a lower arm portion **12*a* extending in a spaced underlying relationship with respect to the lower end of the post 72. The post 72 has end plates 70 and 71 secured at either end thereof. The L-shaped leg member 60 of square cross-section extends through the square aperture 73 formed in the end plate 71 when the leg 60 is secured to the tubular member 62 by means of a compression spring 64. The compression spring 64 is preferably welded to the ends of the leg 60 and the tube 62. A nut 65 is mounted at the upper end of the tube 62 and threadably engages the threaded lower end of the shaft 68. The upper end of the shaft 68 which is not threaded, extends through the passage 75 formed in the end plate 70. A collar 66 is secured to the unthreaded portion of the shaft 68 and cooperates with the head 74 to retain the shaft 68 in the position extending downwardly into the tube 62. Hook members 16*a* extend outwardly from the head 74 from which the fence 14 may be suspended as previously described with respect to FIG. 1** of the drawings.

The leg 60 has a lower portion **12*b* which is disposed in a spaced parallel relationship with respect to the arm 12*a* of the C-shaped bracket 12. The lower face of the arm 12*b* and the upper face of the arm 12*a* each have a hard rubber lever 13** mounted thereon which serves to increase the functional engagement with a concrete structure or the like.

In order to effect clamping the drive means is operated by rotating the head 74 by manually engaging the hooks **16*a*. Rotation of the head 74 results in rotation of the shaft 68. Rotation of the shaft 68 drives the nut 65 longitudinally with respect to the threaded portion of the shaft 68. In order to effect clamping, the head 74 is rotated in a direction which will cause the nut 65 to move downwardly. Downward movement of the nut 65 drives the tube 62 to which it is rigidly connected downwardly. The downward movement of the tube 62 causes the spring 64 and leg 60 to move downwardly. As a result of the downward movement of the leg 60, the edge of a floor 14 may be clamped between the portion 12***b* of the leg 60 and the portion 12*a* of the clamp 12. Continued downward movement of the nut 65 causes the downward movement of the tube 62 which results in compression of the compression spring 64. The compression spring 64 serves to accommodate variations in the thickness of the floor member 14 resulting from temperature variations and the like.

It will be noted that when the fence 12 is suspended from the hooks 16*a*, it is not possible to rotate the head 74 of the drive means. As a result, the fence 12 serves to prevent tampering with the drive mechanism of the clamp. It will also be noted that by reason of the fact that the drive mechanism is located at the upper end of the post, it is readily accessible to permit authorized adjustment when such adjustment is required. In addition, it will be noted that all of the operating mechanism of the posts is enclosed within the tubular member 72 so that it is protected from damage in use and in storage. Furthermore, it is possible to operate the driving mechanism used for the clamping and release of the post without requiring the operator to lean over the edge of the floor so that as a result of the readily accessible drive mechanism, the operator is not placed in the hazardous location when attempting to make adjustments to the fence posts.

To increase the range of thickness of structure to which the C-shaped clamp may be applied, the vertical portion 15 of the C-shaped bracket is formed in two portions 17 and 19 which are connected by means of an intermediate post 21. The post 21 is welded to the portion 19 of the vertical portion 15 and projects outwardly therefrom and is telescoped at its other end with the portion 17. The post 21 is formed with a plurality of passages 23 which extend therethrough and which are alignable with passages 25 formed in the portion 17 of the vertical portion 15. The post 21 is adjustably secured with respect to the portion 15 by means of a bolt 27 which extends through the passages 23 and 25 and is retained by a nut 29. The adjustment provided by this structure is such that the post may be mounted on concrete floors ranging in thickness from 6 to 10 inches or the like. This manner of adjustment also serves to maintain the height of the arm 16*a* above the floor at a substantially constant level by reason of the fact that the amount of movement of the foot 12*b* required to effect clamping is quite small. In order to improve the stability of a fence when suspended from the arms 16*a* in use, an end cap 31 is removably mounted at the post. The cap 31 has U-shaped slots 33 extending inwardly from one end thereof to receive the arms 16*a* such that the cap 31 may rest on the end plate 70 of the post 72. The cap 31 serves to maintain the vertical rigidity of the fence by preventing movement of the lower end of the fence in a direction away from the posts 10.

These and other advantages of the present invention will be apparent to those skilled in the art.

What I claim as my invention is:

1. An end mounted construction fence post comprising a. a hollow tubular post having an upper end and a lower end and a longitudinal axis extending therebetween, b. a C-shaped bracket mounted at the lower end of said post and opening laterally of said axis of said post, said C-shaped bracket having an arm spaced downwardly from and underlying the lower end of said post, c. A shank extending into said hollow tubular post and having a lower end projecting outwardly from the lower end of said tubular post towards said arm, d. drive means at the upper end of said post for driving said shank towards and away from said arm of said C-shaped bracket whereby said shank may cooperate with said arm to releasably clamp said post to a structure disposed therebetween, e. said shank being resiliently longitudinally compressible whereby a clamping force is maintained between said shank and said arm when the proportions of said structure which is disposed therebetween vary due to temperature variations or the like.

2. An end mounted construction fence post as claimed in claim 1 wherein said shank comprises a hollow tubular portion having an upper end and a lower end, a threaded nut mounted at the upper end of said hollow tubular portion, a compression spring extending downwardly from said lower end of said hollow tubular portion, a leg member extending downwardly from said compression spring, said compression spring providing said longitudinal compressibility of said shank.

3. An end mounted construction fence post as claimed in claim 2 wherein said drive means includes a threaded stem mounted at the upper end of said post for rotation about said longitudinal axis and extending longitudinally downwardly into said post and threadedly engaging said threaded nut to drive said shank longitudinally of said tubular post, and means at the upper end of said threaded stem engageable from without said post to permit rotation of said stem.

4. An end mounted construction fence post as claimed in claim 3 wherein said post has a passage opening through said lower end thereof adapted to slidably receive said shank and to prevent rotation of said shank with respect to said post.

5. An end mounted construction fence post as claimed in claim 4 wherein said leg member of said shank has a laterally extending foot portion at the lower end thereof projecting inwardly of said C-shaped bracket in a spaced parallel relationship with respect to said underlying arm.

6. An end mounted construction fence post as claimed in claim 1 including construction fence support means carried by said drive means and cooperating with said construction fence to permit operation of said drive means when a construction fence is supported thereby.

7. An end mounted construction fence post as claimed in claim 1 wherein said C-shaped bracket is adjustable to adjust the distance between the lower end of said hollow tubular post and said arm of said bracket which underlies said lower end of said post.

8. An end mounted construction fence post as claimed in claim 1 wherein said drive means includes at least one support arm projecting radially at the upper end of the post and having a vertically extending portion at the outer end thereof, said arm providing a hook for supporting a fence post therefrom.

9. An end mounted construction fence as claimed in claim 1 including an extension projecting upwardly from the upper end of said hollow tubular post in a spaced relationship with respect to said vertically extending portion of said arm.

* * * * *